US010926166B1

(12) United States Patent
Drake, Jr. et al.

(10) Patent No.: US 10,926,166 B1
(45) Date of Patent: Feb. 23, 2021

(54) ROTATABLE BALL MOMENTUM TRANSFER ASSEMBLY FOR AN AMUSEMENT GAME

(71) Applicant: STERN PINBALL, INC., Elk Grove Village, IL (US)

(72) Inventors: J. Harrison Drake, Jr., Mount Prospect, IL (US); Keith Elwin, Chicago, IL (US)

(73) Assignee: Stern Pinball, Inc., Elk Grove Village, IL (US)

( * ) Notice: Subject to any disclaimer, the term of this patent is extended or adjusted under 35 U.S.C. 154(b) by 0 days.

(21) Appl. No.: 16/660,158

(22) Filed: Oct. 22, 2019

(51) Int. Cl.

| | |
|---|---|
| ***A63F 7/02*** | (2006.01) |
| ***A63F 7/36*** | (2006.01) |
| *A63F 7/30* | (2006.01) |
| *A63F 7/28* | (2006.01) |

(52) U.S. Cl.
CPC ..... *A63F 7/025* (2013.01); *A63F 7/36* (2013.01); *A63F 7/02* (2013.01); *A63F 7/28* (2013.01); *A63F 2007/301* (2013.01); *A63F 2007/3005* (2013.01)

(58) Field of Classification Search
CPC .. A63F 2007/3005; A63F 7/2409; A63F 7/28; A63F 2007/2481; A63F 2007/301; A63F 7/02; A63F 7/025
USPC ..... 273/127 R, 127 D, 127 B, 121 B, 119 R, 273/121 R, 123 R, 118 R, 121 D
See application file for complete search history.

(56) References Cited

U.S. PATENT DOCUMENTS

| | | | | | |
|---|---|---|---|---|---|
| 1,051,549 | A * | 1/1913 | Bugbee | A63F 7/0017 | 273/119 R |
| 2,226,885 | A | 12/1940 | Williams et al. | | |
| 2,362,188 | A * | 11/1944 | Clark | A63F 7/0608 | 273/317.7 |
| 2,791,428 | A | 5/1957 | McDonald | | |
| 3,300,891 | A * | 1/1967 | Glass | A63F 7/3622 | 446/97 |
| D216,999 | S * | 3/1970 | Kanbar | D19/62 | |
| 3,594,925 | A * | 7/1971 | Abbat | A63H 33/00 | 434/302 |
| 4,183,535 | A * | 1/1980 | Goldfarb | A63F 7/3622 | 273/120 R |
| 5,511,783 | A | 4/1996 | Popadink et al. | | |
| 5,913,516 | A * | 6/1999 | Piotrowski | A63F 7/027 | 273/121 A |
| D684,628 | S * | 6/2013 | Hiller | D19/62 | |
| 9,501,952 | B2 * | 11/2016 | Mitchell Jr. | G09B 23/10 | |

* cited by examiner

*Primary Examiner* — Benjamin Layno
(74) *Attorney, Agent, or Firm* — Greenberg Traurig, LLP

(57) ABSTRACT

A rotatable ball momentum transfer assembly for an amusement gam, such as a pinball machine includes an impact ball mounted to an inclined playfield and a shaft mounted to the playfield proximate to the impact ball. A travel ball is coupled to the shaft such that the travel ball rests against the impact ball during gameplay to receive momentum from the impact ball when the impact ball is struck by a game ball, causing the travel ball to at least partially rotate about the shaft. In one example, the travel ball rotates in a fixed arc towards one of two resting positions on either side of the impact ball. These two resting positions both open or close different shot paths available during gameplay.

20 Claims, 6 Drawing Sheets

ROTATABLE BALL MOMENTUM TRANSFER ASSEMBLY FOR AN AMUSEMENT GAME

FIELD OF THE DISCLOSURE

The present disclosure relates generally to amusement games and more particularly to a rotatable ball momentum transfer assembly for an amusement game device, such as a pinball machine.

BACKGROUND

Amusement game devices, such as pinball machines, redemption games, etc. of the commercial, e.g., revenue generating, and non-commercial, e.g., home entertainment, type are generally well known in the art. By way of example, U.S. Pat. Nos. 2,226,885 and 2,791,428 each illustrate and describe amusement game devices, such as pinball games, of the type having a cabinet which houses a confined ball on a playfield, each of which are incorporated herein by reference in their entirety.

In a typical pinball game, a ball is propelled into play on an inclined playfield with a ball plunger assembly and during gameplay, the pinball strikes various elements and gaming assemblies with each strike registering a score and/or a gaming event. The various game elements may include ramps, ball guides, formed lanes, drop targets, pop bumpers, spinners, bash toys, etc. At least two flipper assemblies are usually provided at the lower end of the playfield to propel the ball back into play on the playfield and to impact additional game elements.

In one example, the pinball game includes a linear ball momentum transfer feature, such as described in U.S. Pat. No. 5,511,783. The pinball momentum transfer device utilizes an impact ball anchored to the playfield. The impact ball, in cooperation with guide elements on the playfield, define a ball travel area for a captive ball confined within the guide elements. Momentum can be transferred from a game ball via the impact ball so as to project the captive ball towards a target element contained within the confined area.

While the described linear ball momentum transfer feature, such as described above, may generally work for its intended purpose, there is an identifiable need for various enhancements and improvements to amusement game features such as disclosed below.

BRIEF DESCRIPTION OF THE DRAWINGS

For a better understanding of the rotatable ball momentum transfer assembly disclosed hereinafter reference may be had to the following drawings.

DETAILED DESCRIPTION

The following description of example methods and apparatus is not intended to limit the scope of the description to the precise form or forms detailed herein. Instead the following detailed description is intended to be illustrative so that others may follow the example teachings.

With reference to the figures, an amusement game device, in the example form of a pinball machine 10 is now described. It is to be appreciated, however, that this example form for the amusement game device is not intended to be limiting. Rather, those of ordinary skill in the art will appreciated that the rotatable ball momentum transfer assembly disclosed hereinafter can be utilized in any type of amusement game device of the commercial and non-commercial type in which it is desired to create a target assembly as disclosed.

Figure 1:
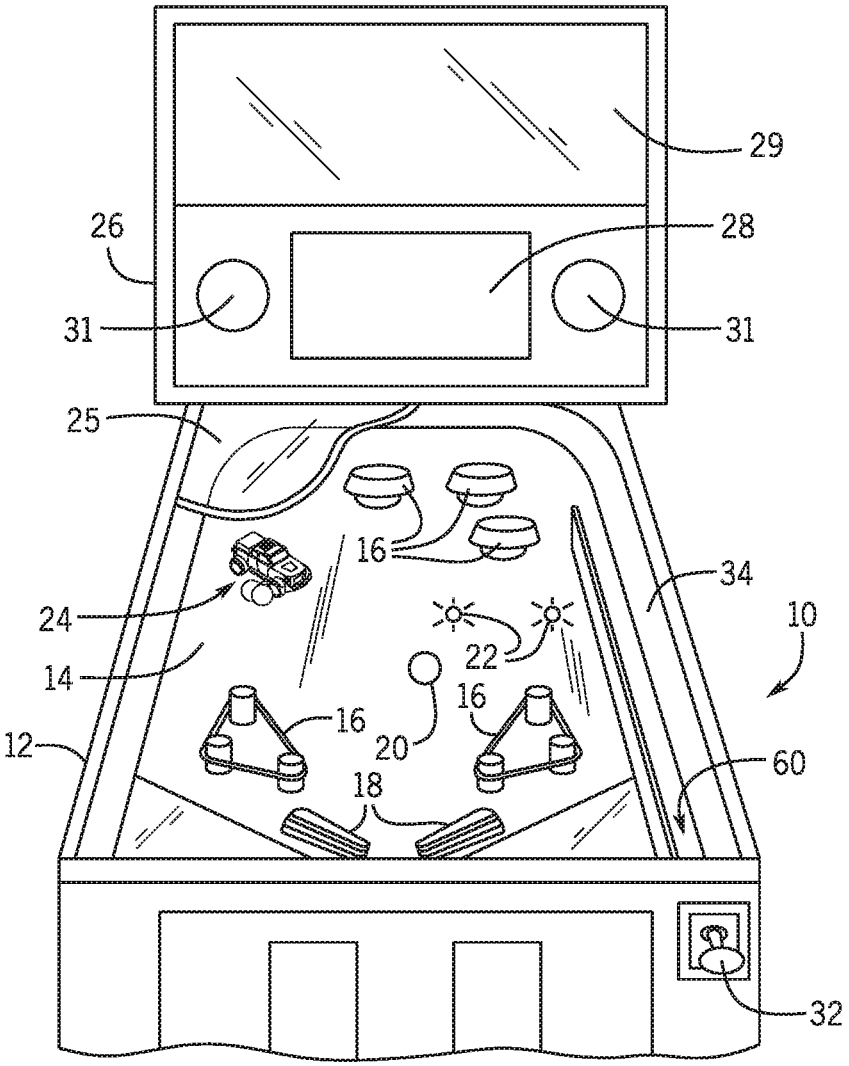
FIG. 1 illustrates an example amusement game device in the form of a pinball machine including an example of the disclosed rotatable ball momentum transfer assembly.

The example pinball machine 10 illustrated in FIG. 1 includes a cabinet 12 which houses various apparatus used to define play of a game. Gameplay may be commenced in response to insertion of money, paper or coins referred to collectively as "coins", into a coin accepting device, upon exercising of credits earned, by accepting payment from an account, e.g., via use of a swipe card reading device, a bar code reading device, a near field communications device, etc., and/or by otherwise making game play active, including free play. Upon activation of the game in this manner, gameplay, in the case of the example pinball machine 10, is defined upon an inclined playfield 14 that supports a number of playfield accessories or devices.

More particularly, in the case of the example pinball machine 10, gameplay is generally defined through the use of a pair of flippers 18 to propel a ball 20 relative to an upperside (e.g., a top surface) of the playfield 14 and input devices/accessories associated with the playfield 14. The playfield 14 is usually inclined from the horizontal, such as for instance between approximately 6.5 to 7.0 degrees, such that the ball tends to eventually roll back down the playfield 14 in the direction of the flippers 18. While not intended to be limiting, the playfield accessories or input devices may include elements such as bumpers 16, ramps, rollover switches 22, and/or at least one rotatable ball momentum transfer assembly 24, which will be described in greater detail hereinafter.

The playfield 14 may be covered by a transparent or glass sheet cover 25 to permit viewing of the playfield 14. In addition to the foregoing, the playfield 14 typically includes a plunger element 32 which shoots or launches the ball 20 up an alley 34 onto the playfield 14. The playfield 14 may also include lighting elements—which may also be included as a part of the any of the input devices/accessories—and/or other features as desired. Other player-activated input elements, typically in the form of push-buttons (not shown) on the sides (or other location) of the cabinet 12, are usually provided for controlling operation of the flippers 18 or otherwise interacting with gameplay. The amusement game 10 may also include a backbox 26 which is mounted to overlay a top rear portion of the cabinet 12 and which in this example contains artwork 29, and a game display 28, such as a dot matrix display, CRT, LED or plasma display, or the like. The backbox 26 may also support speakers 31 associated with the game sound system. Within the backbox 26 may be located various ones of the electronic devices/circuits for controlling the operation of the playfield 14, the display 28, general illumination, and the sound system, including speakers 31 and any additional sound system components. Such electronic devices/circuits could also, in whole or in part, be carried within the game cabinet 12, or may be external to the game cabinet and linked to the machine 10 via any suitable wired or wireless configuration.

Figure 2:
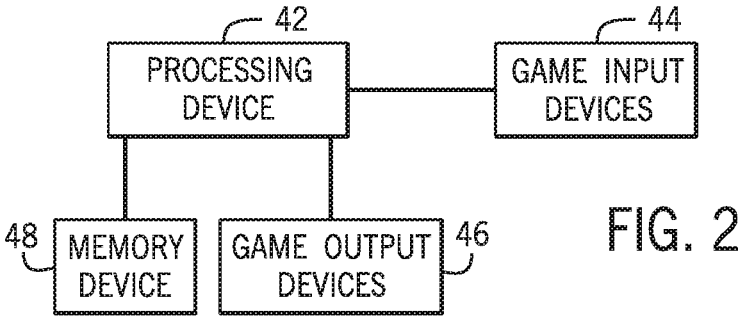
FIG. 2 is an example block diagram of example components of the amusement game device of FIG. 1
Figure 3:
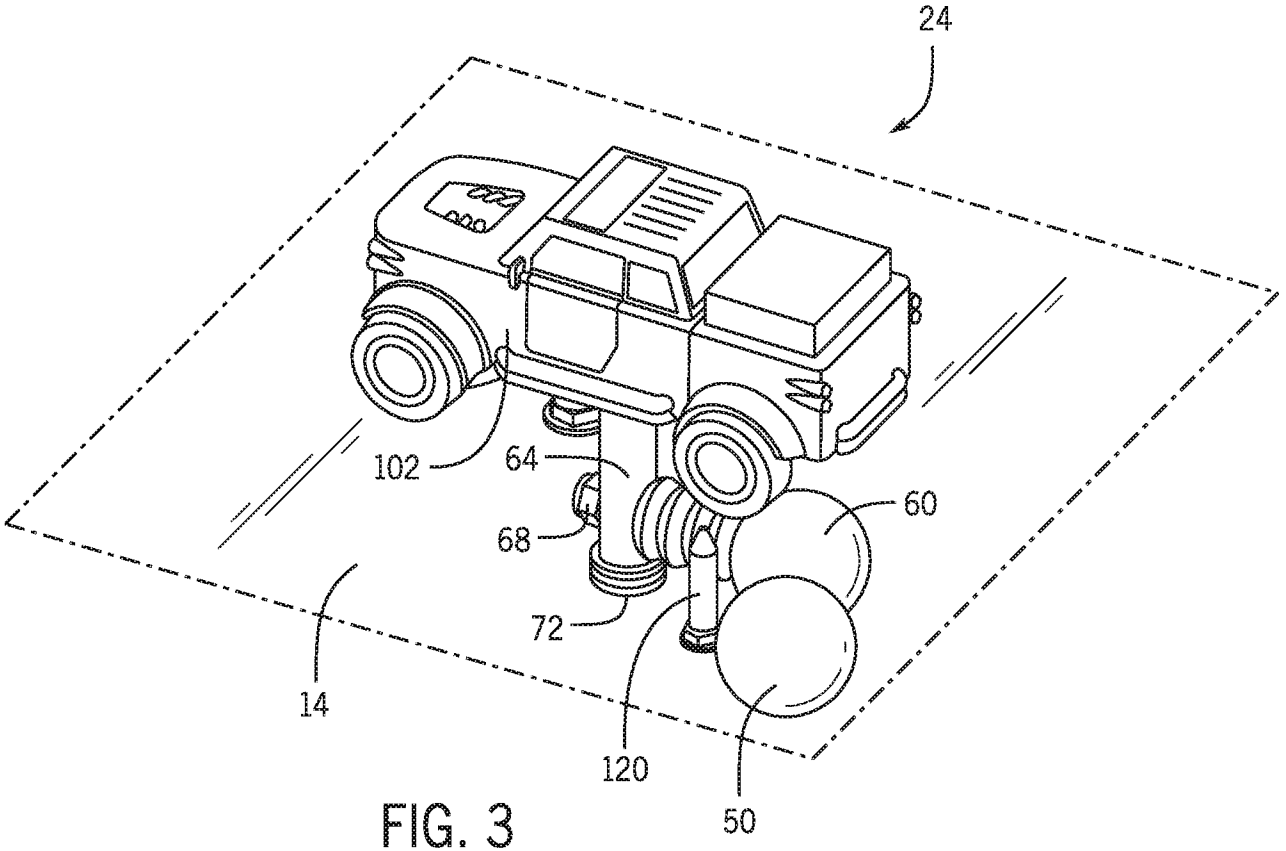
FIG. 3 is a top perspective view illustrating an upper portion of the example rotatable ball momentum transfer assembly as installed on a top surface of an example playfield.

Referring to FIG. 2, for controlling the various devices that form the amusement game, the example pinball machine 10 is provided with a processing device 42 which processing device 42 is, in turn, coupled to game input devices 44, such as switches associated with the cabinet 12, playfield 14 (including the rotatable ball momentum transfer assembly 24), etc., and game output devices 46, such as lights (including lights associated with the playfield 14 and/or the rotatable ball momentum transfer assembly 24, etc.), bumpers 16, flippers 18, display 28, etc. via one or more buss systems. A memory device 48, such as a RAM, ROM, or the like, stores instructions and data usable by the processing device 42 to control play of the game, the game output devices 46, and the game input devices 44 as necessary based upon signals provided by the game input devices 44. It is to be understood that this illustrated embodiment is not intended to be limiting and that other manners for arranging the devices illustrated in FIG. 2 to provide for control of play of the amusement game can be utilized as needed.

Turning now to FIGS. 3-6, various examples of the rotatable ball momentum transfer assembly 24 are illustrated in top perspective and bottom perspective as installed on the playfield 14. For purposes of this specification, the rotatable ball momentum transfer assembly 24 may also be interchangeably referred to as the "newton assembly 24", the "kinetic target assembly 24", or other similar name.

In general, the example kinetic target assembly 24 includes an impact device, such as an impact ball 50 and a rotatable travel device, such as a travel ball 60. While both the impact device and the travel device are illustrated and described herein as a "ball," it will be appreciated by one of ordinary skill in the art that either or both of the impact device and the travel device may be any suitable size, shape, and/or material that allows for the imparting of momentum between the devices and are not limited to "balls" or "pinballs". The impact ball 50 is mounted within an impact ball opening 52 and anchored to the playfield 14 via any suitable fastener. For instance, the impact ball 50 may be secured via a fastener 54 (see FIG. 5), such as an at least partially threaded bolt, extending from the impact ball 50 through the opening 52 and secured to the playfield 14 with a washer 56 and a nut 58.

Figure 4:
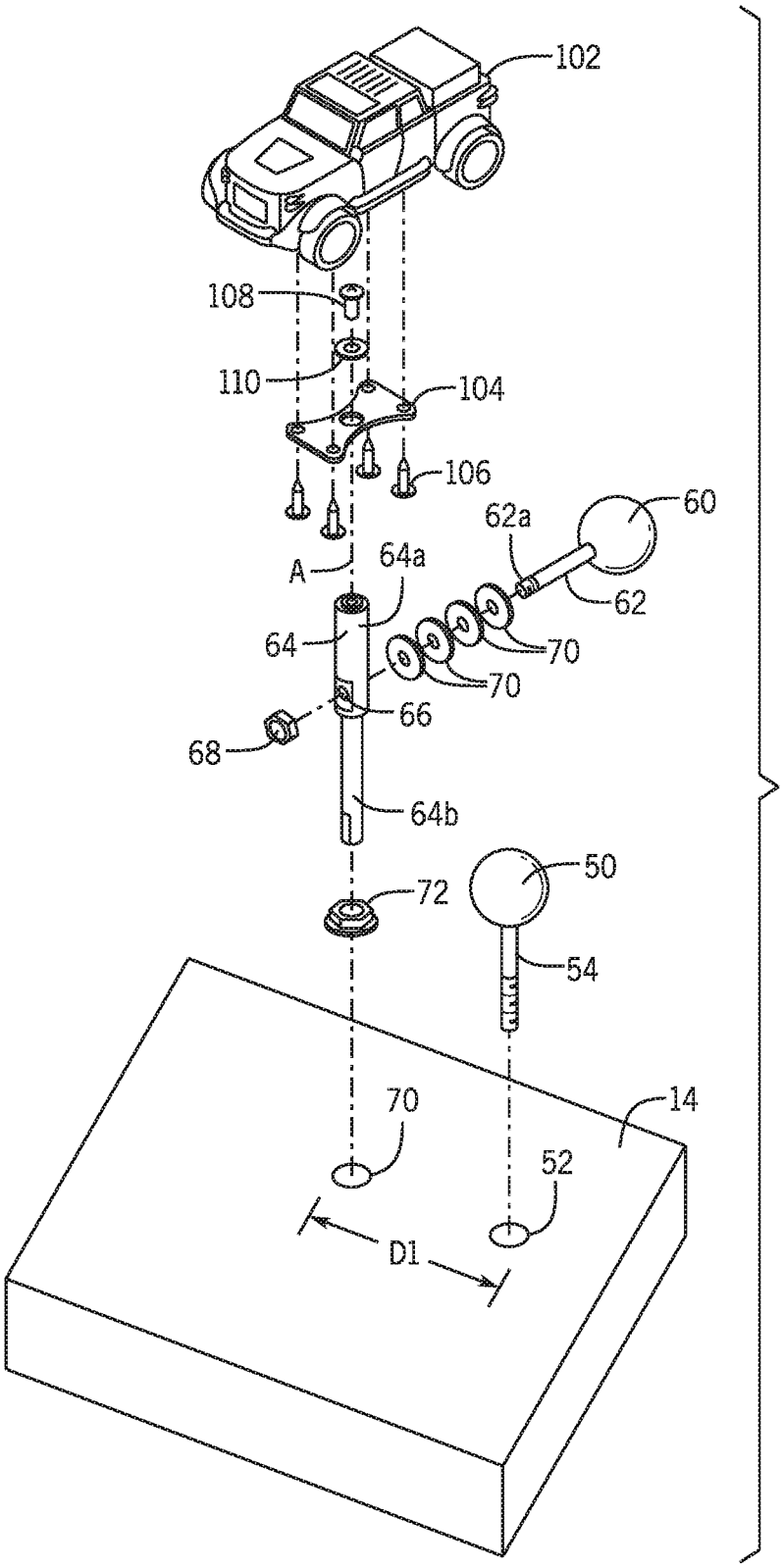
FIG. 4 is an exploded perspective view of the upper portion of the example rotatable ball momentum transfer assembly of FIG. 3.

The travel ball 60, meanwhile, is rotatably mounted to the playfield 14 such that at the extent of the rotation of the travel ball 60, the travel ball 60 will rest against a first or second side of the impact ball 50 as will be described. Thus, the travel ball 60 includes a post 62 extending from the travel ball 60 and being mountable to a rotatable shaft 64 having a longitudinal axis A and extending from the playfield 14, such as perpendicular thereto. As illustrated in FIG. 4, the post 62 includes a threaded portion 62*a* located at the furthest extent of the post 62 distal from the travel ball 60 and is mounted to the shaft 64 through a shaft opening 66, extending transversely through the shaft 64, via a nut 68. An optional sleeve, such as in this example a plurality of gaskets 70 or other suitable sleeve may be utilized over the post 62 to maintain the proper location of the post 62 on the shaft 64 and/or provide aesthetic or decorative details. When mounted to the shaft 64, the post extends generally perpendicular from the shaft 64, and therefore generally parallel to the playfield 14 once coupled thereto.

The shaft 64 is rotatably coupled to the playfield 14 through a rotating shaft opening 70 formed in the playfield 14 a distance D1 from the impact ball opening 52. It will be understood that the distance D1 will be related to the length of the post 62 such that the impact ball 50 and the travel ball 60 contact each other during rotation. To couple the shaft 64 to the playfield 14, the shaft includes an upper portion 64*a* that extends above the playfield 14, and a lower portion 64*b* that extends through and below the playfield 14 for fastening thereto. A bearing 72 may be placed over the lower portion 64*b* of the shaft 64 and be located between the upper portion 64*b* of the shaft 64 and the playfield 14, when installed, to help reduce friction between the playfield 14 and the shaft 64 and to assist in providing a relatively smooth rotation of the shaft 64.

Figure 5:
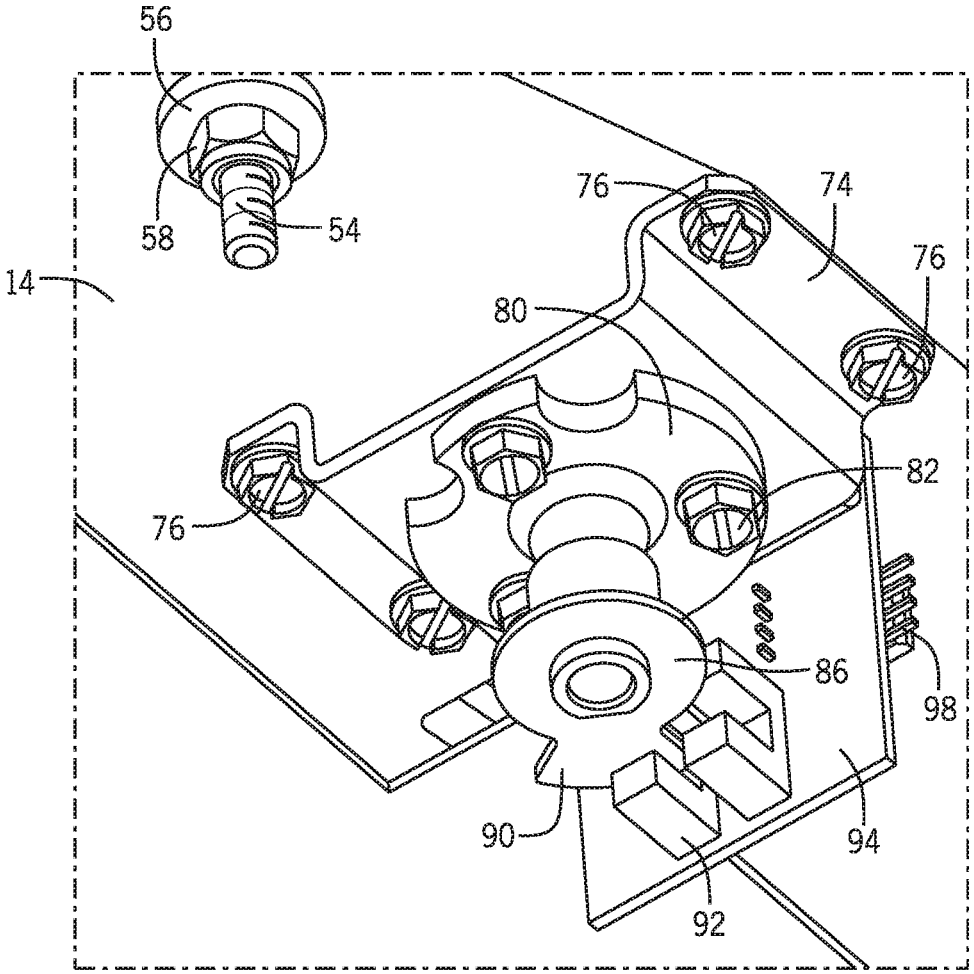
FIG. 5 is a bottom perspective view illustrating a lower portion of the example rotatable ball momentum transfer assembly as installed on a bottom surface of the example playfield.
Figure 6:
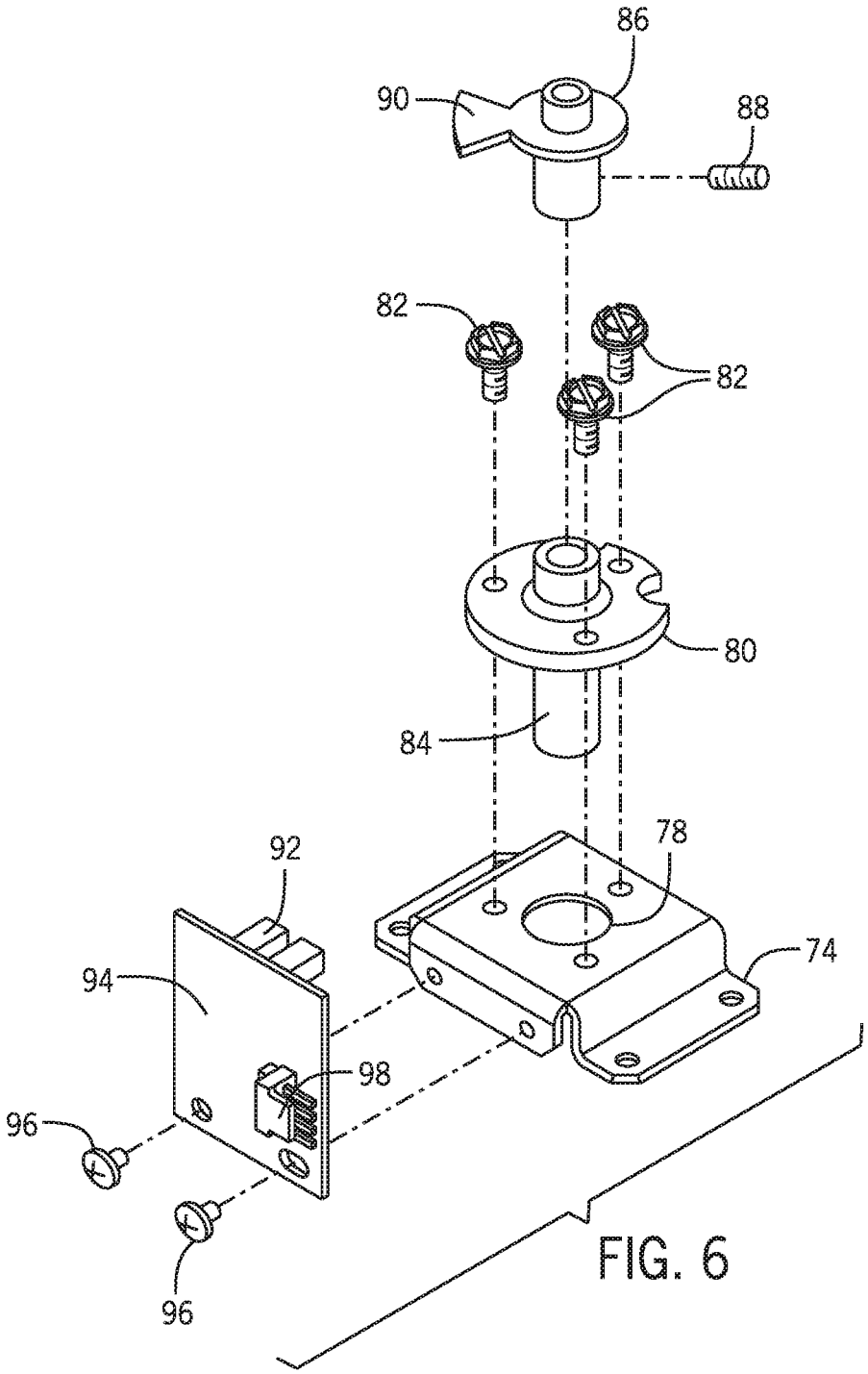
FIG. 6 is an exploded perspective view of the lower portion of the example rotatable ball momentum transfer assembly of FIG. 5.

Referring to FIGS. 5 and 6, to rotatably mount the shaft 64 to the playfield 14, the underside of the playfield is provided with a bracket mount 74, which in this example is mounted to the underside of the playfield 14 via fasteners 76, such as wood screws. The bracket mount 74 includes a bushing opening 78 that is coaxially aligned with the shaft opening 70. A bushing 80 is mounted to the bracket mount 74 via fasteners 82 and includes a sleeve 84 that extends through the bushing opening 78 and the shaft opening 70. The shaft 64 is inserted through the sleeve 84 and is held in place with a cap 86 fastened to the shaft 64 via a set screw 88. Thus, when assembled properly, the shaft 64 is rotatably retained within the opening 70 and within the bushing 80 such that the travel ball 60, the shaft 64, and the cap 86 all rotate as a single unit.

In this example, the rotatable position of the shaft 64, and thus the travel ball 60, may be determined through any suitable sensing device. For instance, in this example, the cap 86 includes a flange 90 that extends circumferentially outward from a portion of the cap 86. The flange 90 cooperates with at least one sensor 92, such as a light sensor located proximate the flange, such that the flange 90 interrupts the light sensor when the shaft 64 is rotated to specific locations. The sensor 92 may be any suitable mechanical or non-mechanical sensor to sense rotation of the shaft 64, such as a reflective sensor, an interrupter sensor, encoders, a magnetic sensor, a Hall-effect sensor, leaf switch, etc. In this example, the sensor 92 is mounted to a printed circuit board 94, which in turn is mounted to the bracket mount 74 via fasteners 96. The printed circuit board 94 additionally includes a connection terminal 98 to electrically couple the sensor 92 to the processing device 42 and to provide rotational position data regarding the shaft 64 to the processing device 42 for gameplay processing.

In operation, the example kinetic target assembly 24 is located on the playfield 14 such that a player launched ball 20 strikes the fixed impact ball 50 restrainingly secured to the playfield 14. This impact between the ball 20 and the impact ball 50 transfers the launched ball's energy to the travel ball 60 that is attached to the rotating shaft 64. The offset of the travel ball 30 relative to the rotational axis A of the shaft 64 allows the travel ball 30 to move about the rotational axis A. In this example, the travel ball 60 travel in a fixed circular arc about the shaft 64, but it will be appreciated by one of ordinary skill in the art that different travel paths of the travel ball 60 may be achieved via different linkages with the shaft 64.

Figure 7A:
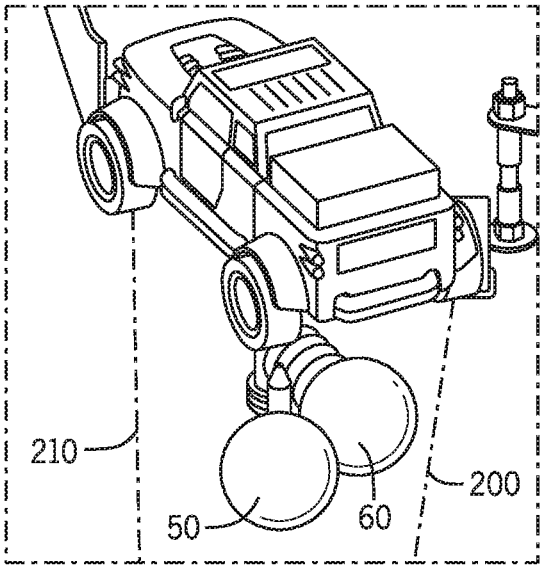
FIG. 7A is a top perspective view of the example rotatable ball momentum transfer assembly of FIG. 3, showing the assembly in a first rotated position.
Figure 7B:
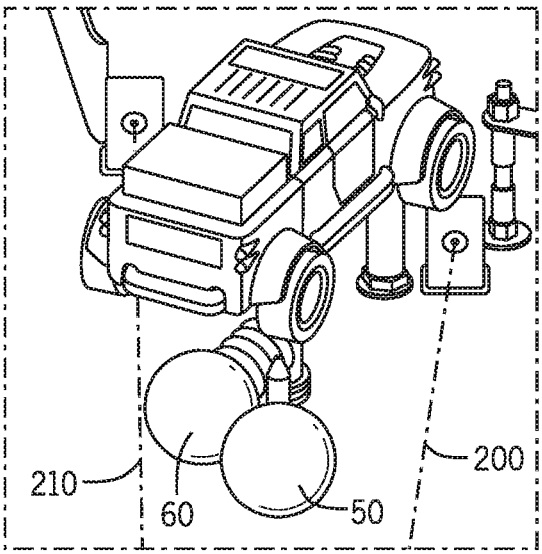
FIG. 7B is a top perspective view of the example rotatable ball momentum transfer assembly of FIG. 3, showing the assembly in a second rotated position.

In additional, due to the incline of a typical playfield 14, and by mounting the shaft 64 upwards of the impact ball 50 along the inclined playfield 14, gravity pulls the travel ball 30 on its fixed arc towards one of two resting positions on either side of the impact ball (as illustrated in FIGS. 7A and 7B). These two resting positions both open or close different shot paths the player can aim for as will be described. In particular, as illustrated in FIG. 7A, the travel ball 60 is rotated to be located on a right side of the impact ball 50 (as looking at the assembly 24 from the lower inclined portion of the playfield 14) and thereby "closing" (i.e., blocking) a ball path 200 to the right side of the assembly 24. Similarly, as illustrated in FIG. 7B, the travel ball 60 is rotated to be located on a left side of the impact ball 50, thereby closing a ball path 210 to the left side of the assembly 24, while simultaneously "opening" (i.e, unblocking) the ball path 200.

It will be appreciated that in addition to the operation components of the kinetic target assembly 24 as disclosed above, the assembly 24 may additionally include decorative elements, such as a toy 102. In this example, the toy 102, which is in the general shape of an automobile, truck, SUV, etc., is mounted to a plate 104 via fasteners 106. The plate 104 is, in turn, mounted to the upper portion 64*a* of the shaft 64 via a fastener 108 and washer 110.

While the example assembly includes a toy truck, it will be appreciated that any number and or variation of gameplay elements may be installed atop the shaft 64 to alter the kinetic target assembly's effect on gameplay. For instance, various decorative toys, lighting elements, etc. can be affixed and utilized to communicate gameplay state changes to the player, such as for example, a truck showing which path the player is taking. Still further, the toy element 102 may include a mechanism such as a ball diverter, which can be affixed to alter shots path that are above the plane of the impact ball 50 (e.g., ramps, etc.). In this case, the diverter mechanism could be used to have two ramps switch exits or open/close a gate on a secondary playfield surface, thus eliminating traditional mechanisms controlled or actuated via solenoids or coils and requiring software control such as used in traditional pinball game designs. This toggle target is unique in that it harnesses a pinballs kinetic energy to actuate gameplay elements, reducing software complexity and machine cost.

While specific examples of the present invention have been disclosed in detail, it will be appreciated by one of ordinary skill in the art that that various modifications and alternatives to those details could be developed in light of the overall teachings of the disclosure. For example, the rotation of the shaft 64 may be ratcheted or otherwise suitably stepped to provide various positions along the rotational arc. Moreover, the shaft itself may be mounted to the playfield 14 such that the shaft 64 does not rotate relative to the playfield 14, but rather, the travel ball 60 may be mounted to the shaft 64 (e.g. via a bearing) such that the travel ball 64 rotates around the stationary shaft 64. In other example modifications, rotation of the travel ball 60 may be limited, restricted, sensed, or otherwise affected by various known gameplay elements such as drop targets, rollover targets, target switches, posts, pop bumpers, etc. Still further, in one example illustrated in FIG. 3, the kinetic target assembly 24 may include an optional post 120 mounted to the playfield 14 to control and/or prevent any unintended contact with the shaft 64 or the travel ball 60 by the ball 20 during gameplay.

The particular arrangements disclosed herein are meant to be illustrative only and not limiting as to the scope of the invention which is to be given the full breadth of the appended claims and any equivalents thereof.

We claim:

1. An amusement game comprising:

a game cabinet supporting an inclined playfield;

an impact ball mounted to the playfield;

a shaft mounted to the playfield proximate to the impact ball, the shaft having a longitudinal axis extending from the playfield; and a travel ball mounted to the shaft such that the travel ball rests against the impact ball to receive momentum from the impact ball when the impact ball is struck by a game ball moving across the playfield, causing the travel ball to at least partially rotate.

2. The amusement game of claim 1, wherein the travel ball is mounted to the shaft, such that both the shaft and the travel ball rotate in a circular arc.

3. The amusement game of claim 2, wherein the playfield defines a shaft opening for rotatably supporting the shaft upright within the opening.

4. The amusement game of claim 3, further comprising a bushing mounted within the shaft opening for rotatably supporting the shaft.

5. The amusement game of claim 2, wherein the travel ball extends transversely from the shaft.

6. The amusement game of claim 5, wherein the travel ball is mounted transversely to the shaft via a rigid post.

7. The amusement game of claim 6, wherein the rigid post comprises a protective sleeve along at least a portion of the rigid post.

8. The amusement game of claim 1, further comprising a sensor for determining the rotational position of the travel ball.

9. The amusement game of claim 8, wherein the sensor is located on an opposite side of the playfield from the travel ball.

10. The amusement game of claim 8, wherein the sensor is an optical sensor.

11. The amusement game of claim 10, wherein the shaft comprises a flange extending from the shaft and the flange interrupts the optical sensor to determine the rotational position of the travel ball relative to the playfield.

12. The amusement game of claim 1, further comprising a decorative gaming element coupled to the shaft.

13. The amusement game of claim 1, wherein the shaft extends generally perpendicular from the playfield.

14. The amusement game of claim 1, wherein the travel ball rotates about the longitudinal axis of the shaft.

15. The amusement game of claim 14, wherein the travel ball rotates in a circular arc.

16. The amusement game of claim 1, further comprising a post mounted to the playfield between the impact ball and the shaft.

17. The amusement game of claim 1, wherein the shaft is located upward of the impact ball on the inclined playfield.

18. The amusement game of claim 1, wherein the travel ball rests against the impact ball in a first position and upon full rotation of the travel ball, the travel ball rests against the impact ball in a second position different from the first position.

19. A rotatable ball momentum transfer assembly comprising:

an impact ball fixedly mountable to an inclined playfield;

a shaft mountable to the playfield proximate to the impact ball and extending from the inclined playfield; and a travel ball transversely mounted to the shaft such that the travel ball rests against the impact ball to receive momentum from an impact against the impact ball when the impact ball is struck by a game ball moving across the playfield to cause the travel ball to at least partially rotate about the shaft.

20. The rotatable ball momentum transfer assembly of claim 19, wherein the travel ball is mounted to the shaft such that both the shaft and the travel device rotate in a circular arc about a longitudinal axis of the shaft.

* * * * *